US007003922B2

(12) United States Patent
Fifield

(10) Patent No.: US 7,003,922 B2
(45) Date of Patent: Feb. 28, 2006

(54) INTERLOCKING ROOF TILES

(75) Inventor: John Fifield, Buckinghamshire (GB)

(73) Assignee: Westile, Inc., Casa Grande, AZ (US)

( * ) Notice: Subject to any disclaimer, the term of this patent is extended or adjusted under 35 U.S.C. 154(b) by 11 days.

(21) Appl. No.: 10/301,802

(22) Filed: Nov. 21, 2002

(65) Prior Publication Data

US 2003/0115819 A1 Jun. 26, 2003

(30) Foreign Application Priority Data

Nov. 22, 2001 (GB) ..... 0128065

(51) Int. Cl.
*E04B 1/70* (2006.01)

(52) U.S. Cl. ..... 52/302.1; 52/533; 52/553

(58) Field of Classification Search ..... 52/302.1, 52/302.4, 519, 533, 541, 553, 555, 560
See application file for complete search history.

(56) References Cited

U.S. PATENT DOCUMENTS 1,427,968 A * 9/1922 Pedersen ..... 52/538
4,914,885 A * 4/1990 Baker et al. ..... 52/520
6,367,221 B1 * 4/2002 Elliott ..... 52/519

FOREIGN PATENT DOCUMENTS

| | | | |
|---|---|---|---|
| EP | 0175500 | | 3/1986 |
| EP | 0175500 A2 | | 3/1986 |
| GB | 1400185 | | 7/1975 |
| GB | 1400185 A | | 7/1975 |
| GB | 2278799 | | 12/1994 |
| GB | 2302838 | | 2/1997 |
| WO | WO 94/18413 | | 8/1994 |
| WO | WO9418413 | * | 8/1994 |

* cited by examiner

*Primary Examiner*—Milton Nelson, Jr.
(74) *Attorney, Agent, or Firm*—Dinsmore & Shohl LLP

(57) ABSTRACT

An extruded concrete interlocking roof tile has upper and under surfaces, upper and lower edges, two opposite side edges, with the upper surface having a recess extending transversely between the two opposite side edges adjacent the upper edge for receiving a lower edge region of an adjacent tile in overlapping relationship, and in that an integral spacer acts between the recess floor and the under-surface of the adjacent tile.

10 Claims, 7 Drawing Sheets

INTERLOCKING ROOF TILES

BACKGROUND OF THE INVENTION

The present invention relates to interlocking roof tiles which are made of a cementitious mixture such as concrete and formed by extrusion and more particularly but not exclusively to interlocking roof tiles which are to be laid in broken bond. In this specification the term roof tiles also includes "cladding tiles".

Interlocking roof tiles have a generally rectangular configuration when considered in plan and have an upper and under surface (in use), two oppositely facing side edges, an upper edge and lower (leading) edge which is visible in use when the tile is laid in overlapping relationship with at least one tile of a next adjacent row of tiles, an underlock extending along one of the side edges and an overlock extending along the other of the side edges. The over and underlocks respectively engage with the over and underlocks of adjacent tiles of the same row.

A major advantage of interlocking tiles over both natural slate and concrete plain tiles is that the necessity to double lap the tiles is removed thereby reducing the number of laid tiles per roof and consequently the cost. With natural slate and concrete plain tiles, the thickness of the visible lower edge when the tiles are laid (commonly 10 mm and 12 mm, respectively) provides an aesthetically pleasing appearance. Therefore a further objective of interlocking tiles is to retain the aesthetic appearance produced by broken bond laying, and maintain a visible lower edge similar to existing natural slate and concrete plain tiles, in particular in the case of retiling old roofs.

Early interlocking concrete slate tiles had a substantially flat geometry with relatively thick lower edges (25 mm) when compared with natural slate and concrete plain tiles. This thickness was thought necessary to provide sufficient strength to avoid "breaking off" and to accommodate the interlocks (i.e. the over and underlocks extending along opposite side edges respectively of each tile). The thickness and resulting mass of these tiles deemed them an unsuitable replacement for natural slate.

An interlocking tile with a thin lower edge was achieved (DE 93888) but these tiles were inherently incapable of being extruded by virtue of their two layered design and had to be made by moulding.

In general, moulded or pressed tiles provide a larger range of shape and dimension options than extruded tiles. However, as the tile production rate by moulding is low and therefore more costly, extrusion is preferred as a manufacturing method.

Interlocking roof tile production by extrusion of cementitious materials including cement, sand, fillers and pigment, involves apparatus including an extrusion head comprising a hopper-like box which is disposed above a conveyor path and which is charged with the cementitious mixture. The flow of the cementitious mixture is assisted in the box by means of a rotating paddle. A succession of pallets for moulding the under surface of the tiles is driven along the conveyor path and past the box so that the cementitious mixture from the box forms on the pallets and is compressed thereon by means of a rotating roller mounted within the box downstream of the paddle, and having a contour which corresponds to the upper surface of the tiles to be formed.

The cementitious mixture is further compressed on the pallets as they pass out of the box by means of a slipper which is disposed downstream of the roller and also has a contour which corresponds to that of the upper surface of the tile to form a continuous extruded ribbon of cementitious mixture on the pallets.

A limiting feature of the upper surface contour being formed in this way is that only features of shape which lie in the direction of extrusion can be formed because any features transverse to this direction will be removed by the action of the roller and slipper.

The extruded ribbon of cementitious mixture on the pallets is subsequently cut into tile forming lengths downstream of the box by means of a suitable cutting knife, optionally with nail holes being formed in the tile forming lengths at the same time. The pallets with the formed tiles thereon are then conveyed to a curing chamber where the tiles undergo only a partial curing and are then conveyed to, and stacked, out-of-doors to complete the curing process.

After partial curing, the tiles are depalleted, for example by means of rotating depalleting wheels disposed on opposite sides of the conveyor path. In operation, the wheels successively enter in between the pallets and tiles, with the tiles continuing along the original conveyor path, and the pallets being carried downwards along a different conveyor path, thereby separating the tiles from the pallets.

The applicant has previously manufactured interlocking extruded concrete slate tiles with a thin leading edge (approximately 10 mm), as described in EP 0387305. This tile has the generally flat geometry of natural slate and a hidden interlock. The thin leading edge is achieved by the under surface portion adjacent to the leading edge being inclined at an angle with respect to the upper surface (i.e. thinned). The interlock is hidden from view by virtue of a cut-out at the leading edge region of the underlock which cut-out is occupied when the tile is laid by an extending portion of the leading edge on the opposite side edge. This not only shields the interlock but it also provides a leading edge line without any 'rat holes'.

Rat holes form between the underlock of each tile in one row and the upper surface of each overlapping tile in the row below if interlocking tiles with underlocks which extend the entire length of one of the side edges are laid together to form a roof. This is a consequence of the under surface of the underlock being raised in relation to the lower line of the leading edge so that the two would appear staggered when viewed from the tile leading edge. Rat holes are undesirable as they are both unsightly and allow the ingress of wind driven rain into the roof space.

It is a bonus that in a laid roof of the interlocking tiles described in EP 0387305, the hidden interlocks between adjacent tiles, provide a straight leading edge line that has an aesthetically pleasing appearance. The tile can also be manufactured with a longitudinal groove running the full length of the tile thereby forming a one-piece two tile plain tile.

The applicant has also manufactured an extruded interlocking roof tile, as described in GB 2327954, also with a hidden interlock and being essentially flat, i.e. having the same overall thickness at the upper and leading edges. The upper and lower edges of this flat interlocking roof tile are presented by respective transverse ridges. These transverse ridges are of substantially equal overall thickness and present the lowest point of the tile with the tile under surface having regions that extend along the two side edges and which are substantially mutually parallel. This flat interlocking tile is provided with a hidden interlock to which end the transverse ridges are coterminous with a laterally extending surface of the overlock, and the underlock terminates short of the lower edge to provide a cut-out, such that when the tile is laid in overlapping relationship with an adjacent similar tile, a ridge portion adjacent the overlock is received in the cut-out whereby to shield the interlock from view.

In forming the cut-outs mentioned above, the tile forming material being removed (a so-called coupon) to form the cut-out must be cleanly and quickly achieved and subsequently removed without damaging the tile. To achieve this, extensions to the cutting knife or other modifications to existing equipment used in the extrusion process for making such tiles are known but involve some considerable expense and inconvenience over and above the existing extrusion process. Care must be taken in facilitating outward displacement and avoiding risk of damaging the tile during outward displacement of the coupon by the cutting knife.

An example of one such cut-out formation method, in the manufacture of flat interlocking roof tiles, is described in GB 2327954. The apparatus for forming the coupon in GB 2327954 includes a resilient cutting blade appended to the cutting knife used for severing the extruded ribbon into tiles. Coupon displacement from the main body of the ribbon is achieved by the resilient cutting blade co-operating with an inclined surface upstanding from the pallet surface. The inclined surface is presented by a ridge portion which forms an L-shaped ridge and which forms an L-shaped depression in the undersurface of the ribbon. By means of the resilient cutting blade, a line of separation extending substantially parallel to the direction of extrusion is formed in the ribbon and when the resilient cutting blade engages the inclined surface on the pallet, it flexes outwardly thereby exerting an outwardly directed force on the tile forming material to displace the coupon of tile forming material outwardly of the tile.

Unless barriers are provided in front of the cut-outs in such tiles, wind driven rain may ingress into the roof space. Such barriers are provided in both the interlocking roof tiles mentioned above, and described in EP 0387305 and GB 2327954, by transverse ridges at the leading edge on the underside of the adjacent tile which occupies the cut-out. When two tiles are laid in side-by-side interlocking relationship, the underlock and overlooks matingly engage and the cut-out is filled by an extending portion of the leading edge on the opposite side edge. A portion of the transverse ridge then provides a barrier which both shields the interlock from view and prevents wind driven rain entering the roof space.

Such barriers as described in the preceding paragraph, may also be necessary in contoured tiles, in particular contoured tiles to be laid at low pitch. Contoured tiles, as described in GB 1174992, have a trough (pan) which extends between the upper and lower edges of the tile. In order to prevent the passage of water between adjacent surfaces of two vertically adjacent contour tiles, the tile is provided with a barrier means extending across the trough and inset from the leading edge of the tile. The barrier means cannot be formed on the tile as part of the normal extrusion process as it is transverse to the direction of extrusion and would be removed by the action of the roller and slipper. Therefore, the barrier means on the contour tile is formed by pressing a bar of material, from which the tile itself is being made, into the material of the ribbon before the tile forming length is severed from the ribbon, as described in GB 1174993. Again the disadvantages associated with such a method include the additional equipment and processing steps required in addition to the basic tile forming extrusion procedure. Associated with this are additional costs and increased risks of interruptions in the manufacturing process and consequential undesirable down time.

SUMMARY OF THE INVENTION

Against this background, the present invention seeks to provide an extruded interlocking roof tile with a thin leading edge, and hidden interlock and hidden other under surface features which avoids or minimises the disadvantages of the current tile manufacturing methods as detailed above.

Accordingly, and from one aspect, the present invention consists in an extruded interlocking roof tile made from cementitious material and having upper and under surfaces, upper and lower (leading) edges, and two opposite side edges, wherein the upper surface has a recess extending transversely between the two opposite side edges adjacent the upper edge for receiving a lower edge region of an adjacent tile in overlapping relationship, and integral spacer means acting between the recess floor and the undersurface of the said adjacent tile.

By means of the invention, there is provided an extruded interlocking roof tile with integral features and having a thin leading edge and a hidden interlock whose concealment can be achieved without the need for cut-outs whilst providing a barrier to water ingress into the roof space when the tiles are laid to form a roof and which can be manufactured with a minimum number of manufacturing steps.

Moreover, the spacer means acts to reduce the contact surface area between the overlapping tiles, thereby minimising capillary action water uptake between these tiles. The spacer means also provides ventilation passages between the tiles.

Advantageously, the tile is provided with a transversely extending shoulder which projects from the recess floor and defines the lower edge of the recess. Put another way, the recess is essentially open on all sides except its lower edge which is delimited by the shoulder that preferably, for aesthetic reasons, has a curved portion that merges into the upper surface. These open sides of the recess are defined by the tile upper edge and portions of both side edges respectively adjacent the tile upper edge. In use, the shoulder acts as a stop for the leading edge of the adjacent overlapping tile.

Beneficially, this shoulder permits the appearance of thin visible leading edges on adjacent overlapping tiles when a plurality of such tiles are laid to form a roof. On a roof, tiles are laid in side-by-side interlocking and upper edge to leading edge overlapping relationship, wherein the leading edge of the adjacent overlapping tile abuts against the shoulder such that only a transverse portion of the leading edge thickness is visible above the shoulder. The degree of visibility of the leading edge above the shoulder and hence the so-called 'visible thickness' of the leading edge may be most easily varied by altering the height of the spacer means from the recess floor. The projection of the shoulder from the recess floor or the nominal thickness of the tile leading edge can also be altered to change the leading edge 'visible' thickness.

A thin leading edge on an extruded tile has previously been achieved by tapering the tile at its leading edge, as described in EP 0387305. The extent of the taper and the overall thinness of the tile, however, are limited by the reduction in tile strength and toughness. In embodiments of the present invention, a roof tile should have sufficient strength to survive workmen walking on the roof during repairs and also resist breakage during tile transit and storage. Extremely desirable visible thin leading edges which enhance the aesthetic effect of the laid roof tiles are provided without the need to thin physically the tile and compromise the strength and toughness properties of the tile.

Furthermore, the shoulder acts as a screen in that it hides the interlocks and other under surface features of adjacent overlapping tiles from view when the tiles are laid to form a roof. The shoulder also acts as a barrier to wind driven rain thereby preventing rain from entering the roof space. As aforesaid, hidden interlocks on extruded tiles are currently achieved by cut-outs at the leading edges of the underlocks. This cut-out is occupied, when the tile is laid, by an extending portion of the leading edge on the opposite side edge of the adjacent tile. A ridge on the underside of the leading edge also acts as a rain barrier on this type of tile. Manufacturing these tiles involves adapting existing extrusion equipment to form the cut-outs and to remove the resulting coupons. This process can be both unreliable and costly in terms of production efficiency. On the other hand, extruded interlocking roof tiles made in accordance with the present invention avoid the need for cut-outs and can be manufactured with existing extrusion equipment, as explained later.

Preferably, for ease and simplicity of manufacture, the spacer means is integral with the recess floor, and comprises a plurality of spaced apart projections which co-operate with contours on the tile undersurface when tiles are laid in side-by-side interlocking and upper edge to leading edge overlapping relationship. The contours conveniently comprise at least one ridge and at least one groove extending between the upper and lower edges in parallel with the side edges. The projections extend into the grooves and abut against a side of a ridge to locate the adjacent overlapping tiles in broken bond. As the tiles can only be located in broken bond, it ensures that the tiles will always be correctly aligned. In addition, the grooves, which are formed in the under surface during the extrusion process, reduce the weight of the tile, whilst the remaining ridges on the tile under surface are sufficient for reinforcement.

In a preferred embodiment of the present invention, water discharging from the interlocks of the overlapping tile freely flows out of an indentation (weep area) on the shoulder and onto the surface of the directly underlying tiles. The weep area is in alignment with the interlocking region of the overlapping tiles. While this weep area allows the interlocks of the tiles to be visible when viewed from above, the interlocks remain concealed when viewed from ground level and effectively at an acute angle from the horizontal.

From another aspect, the invention resides in a roof structure, comprising a plurality of any of the interlocking tiles defined hereinabove, laid in side-by-side interlocking and upper edge to leading edge overlapping relationship to form a roof. The ridge of the roof structure is formed by a plurality of ridge tiles and the longitudinal edges of the ridge tiles overlap the recesses and abut the shoulders of the adjacent row of interlocking roof tiles.

Ventilation spaces are provided between overlapping ridge tiles and roof tiles, and between rows of overlapping interlocking roof tiles, by virtue of the spacer means projecting from the tile recess floor. For additional ventilation of the roof space, one or more of the interlocking roof tiles can be replaced with ventilation tiles which co-operate with the existing roof tiles in a side-by-side interlocking and upper edge to leading edge overlapping relationship. Ventilation in roof spaces is essential in order to prevent mould growth, rot and distortion of roof timbers, metal corrosion, ceiling damage and reduced thermal insulation, all caused by uncontrolled condensation.

The invention comprehends a method of making an extruded interlocking tile made from cementitious material and having upper and under surfaces, upper and lower edges, and two opposite side edges, the upper surface having a recess extending transversely between the two opposite side edges adjacent the upper edge for receiving a lower edge region of an adjacent tile in overlapping relationship, and integral spacer means acting between the recess floor and the undersurface of the said adjacent tile, said method comprising supplying a cementitious mixture to successive pallets such that the upper surface of each tile is formed by a respective pallet and that the undersurface of each tile is formed by compressing the cementitious mixture on the respective pallet.

By means of the method of the present invention, additional aesthetic features can be incorporated into the upper surface of the tile such as horizontal banding. The appearance of horizontal banding across laid roofs can be achieved by sinuous profiles of the tiles when the tiles are viewed from each of the side edges.

BRIEF DESCRIPTION OF THE DRAWINGS

In order that the invention may be more readily understood, some embodiments thereof will now be described, by way of example, with reference to the accompanying drawings, in which.

DETAILED DESCRIPTION OF THE PREFERRED EMBODIMENTS

Figure 1:
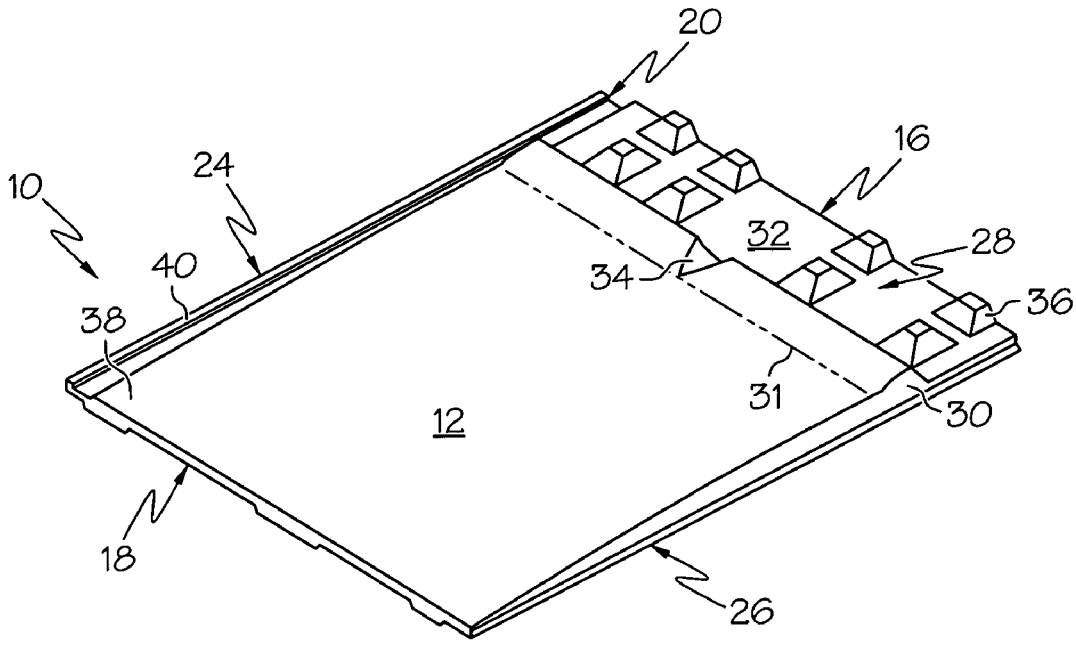
FIG. 1 is a perspective view of one embodiment of an extruded interlocking roof tile, manufactured in accordance with this invention, and viewed from the upper surface, overlock side and lower (leading) edge.
Figure 2:
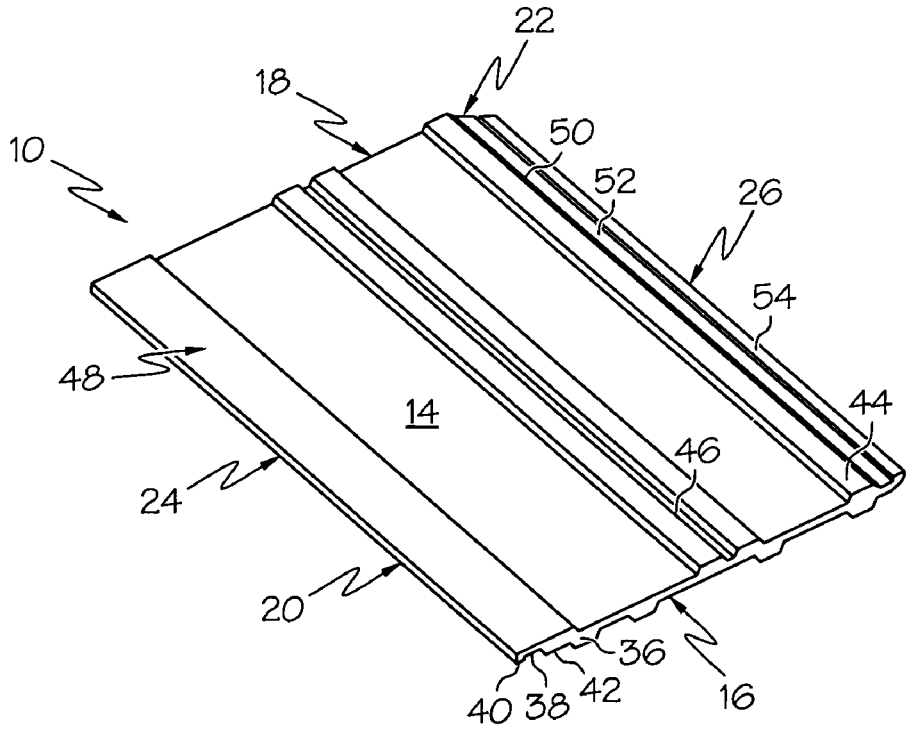
FIG. 2 is a perspective view from the under surface, underlock side and upper edge of the tile of FIG. 1.

Referring initially to FIGS. 1 and 2, there is shown an extruded interlocking roof tile 10 of generally rectangular shape, made of a cementitious material and having an upper surface 12, an under surface 14, an upper edge 16, and a lower (leading) edge 18. The tile also has interlocks 20 and 22 extending along its opposite side edges 24 and 26, in the form of an underlock 20 on the upper surface 12 and an overlock 22 on the under surface 14.

A recess 28 on the upper surface 12 of the tile 10 extends transversely between the two opposite side edges 24, 26 adjacent the upper edge 16 to receive a leading edge 18 region of an adjacent tile in overlapping relationship. The leading edge of the recess is delimited by a transversely extending shoulder 30 which projects from the recess floor 32 and acts as a stop for the leading edge 18 of the said adjacent tile. The recess 28 is open on its other sides, and these sides are defined by the tile upper edge 16 and portions of the tile side edges 24, 26 adjacent the upper edge 16 of the tile.

The shoulder 30 has a curved portion 31, most clearly seen in FIG. 1, that merges into the tile upper surface 12. In side view from each of the side edges 24, 26, the upper surface 12 is provided with a sinuous profile, as can be readily appreciated from FIGS. 1 and 6. This gives the appearance of horizontal banding 33 on a laid roof 59 which provides an attractive aesthetic feature (see FIG. 7). There is also an indentation 34 mid-way along the transverse length of the shoulder 30 which is a weep area for discharging rain from adjacent overlapping tiles onto the tile upper surface 12.

Spacer means, in the form of a plurality of spaced apart projections 36, is integral with, and projects from the recess floor 32. The spaced apart projections 36 are of truncated pyramidal shape. Each projection 36 projects less than the shoulder 30 from the recess floor 32.

There are four pairs of projections 36 projecting from the recess floor 32. The pairs comprise two projections 36 aligned one in front of the other in the direction from the upper edge 16 to the leading edge 18 and parallel to the side edges 24, 26. One pair of projections 36 are located adjacent the side edge 26 on the upper side of the overlock 22. Located inwardly from the side edge 26 are two pairs of projections 36 positioned either side of the indentation 34. The fourth pair of projections 36 are located near the opposite side edge 24. The transverse spacings between the projection pairs are unequal and correspond with contours on the tile undersurface 14, for a purpose to be described.

Figure 3:
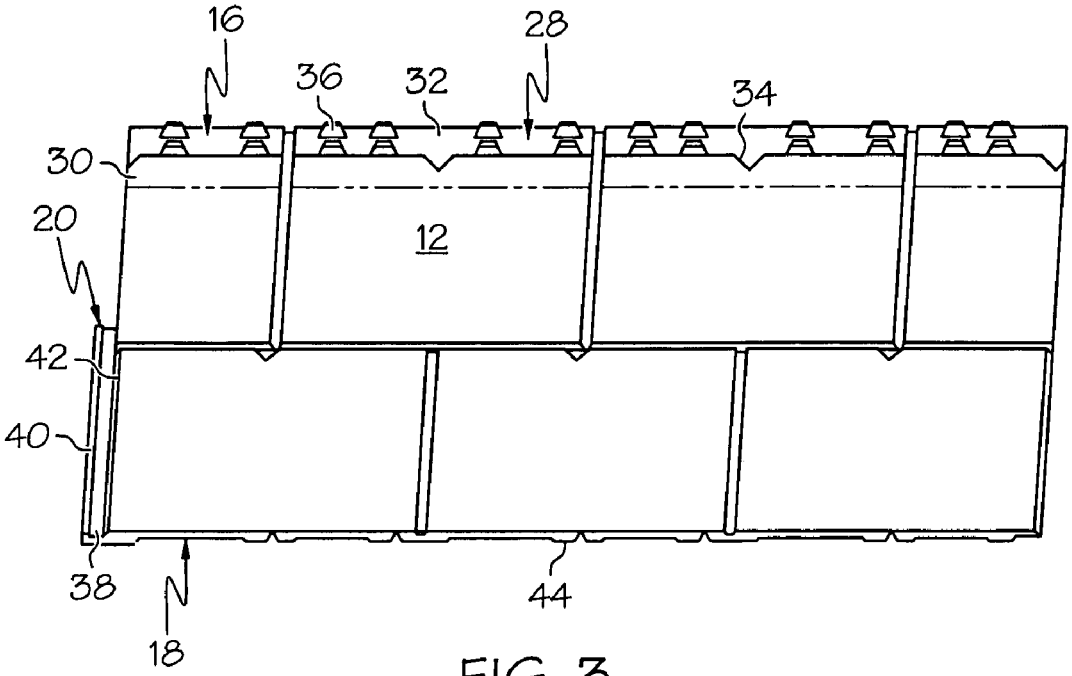
FIG. 3 is a perspective view of two rows of the tiles of FIGS. 1 and 2 laid in side-by-side interlocking and upper edge to leading edge overlapping relationship with parts of tiles cut away for clarity.

The underlock 20 extends along the side edge 24 and is of uniform thickness. As is usual, and as can be seen in FIGS. 1 and 3, the underlock 20 comprises a relatively wide channel 38 and a relatively thin locating rib 40 whose outer surface forms part of the side edge 24. Inwardly of the underlock 20 is a step 42 which is formed in the upper surface 12 of the tile 10 and which extends along the whole length of the tile 10, from upper edge 16 to leading edge 18, with a width of approximately 5 mm.

The under surface 14 comprises a flat lip 48 which is under side the underlock 20 and along the side edge 24, contours, an overlock 22 along the side edge 26, and a step 50 adjacent the overlock 22, all of which extend between the upper and leading edges and constitute regions which are substantially mutually parallel.

As can be most readily seen in FIG. 2, the overlock 22 comprises a relatively wide channel 52 and a relatively thin locating rib 54 which extend between the upper 16 and leading 18 edges. The step 50 is of the same width and is of a complementary shape to the step 42 and matingly engages the step 42 of an adjacent interlocking tile in the laid roof.

Turning now to the undersurface 14 of the tile 10, the contours comprise three ridges 44, and three grooves 46 extending between the upper edge 16 and leading edge 18 in parallel with the side edges 24, 26. Two of the ridges 44 are located substantially midway across the under surface 14 of the tile 10 and are separated from each other by a relatively thin groove 46. The third ridge 44 is adjacent the step 50 and under side one pair of the projections 36. The second groove is positioned between the flat lip 48 and the closest of the central ridges to the flat lip 48. The third groove is located between the other central ridge and the third ridge adjacent the step 50.

Figure 4:
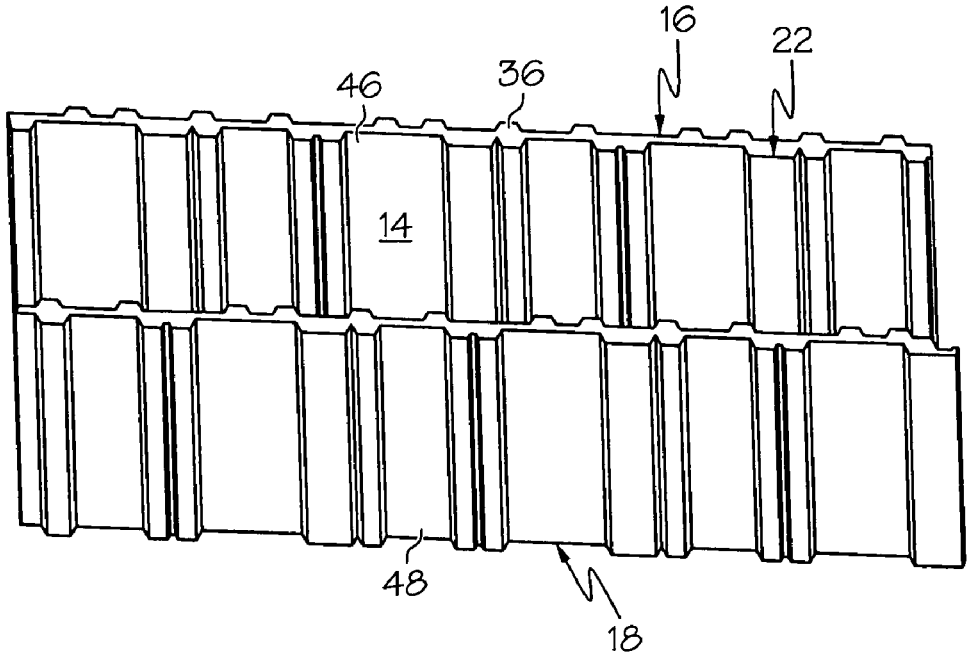
FIG. 4 is a plan view of the under surface of the two rows of tiles of FIG. 3 viewed from the leading edge and with parts of the tiles cut away for clarity.
Figure 5:
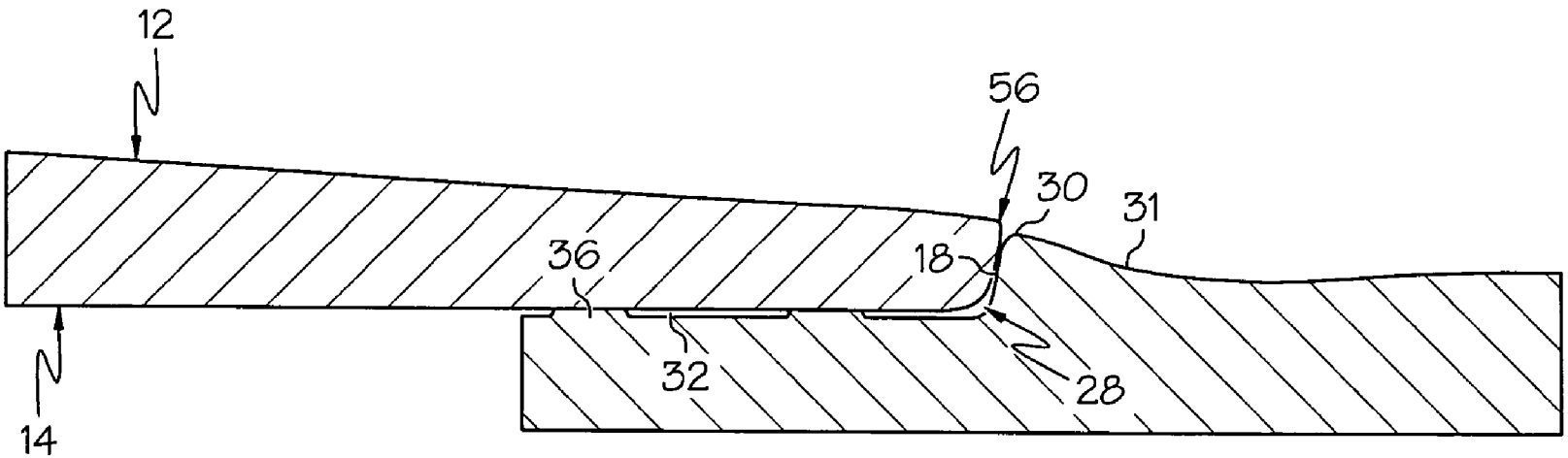
FIG. 5 is a cross-section through an overlap region of two rows of the tiles of FIG. 3.

Reference will now be made to FIGS. 3, 4 and 5 where tiles 10 are laid in side-by-side interlocking and upper edge to leading edge overlapping relationship. In side-by-side interlocking relationship, the channels 52, 38 and ribs 54, 40 of the overlooks 22 and underlocks 20 link together. Rows 55 of tiles 10 overlap each other such that the recess 28 receives the leading edge 18 portion of an adjacent overlapping tile. The shoulder 30 acts as a stop for the leading edge 18 of the adjacent overlapping tile such that the leading edge 18 of the adjacent overlapping tile abuts the shoulder 30 when the tiles are laid. When a plurality of tiles 10 are laid in upper edge 16 to leading edge 18 overlapping relationship, the projections 36 co-operate with the contours, comprising respective grooves 46 and ridges 44, in that the projections 36 extend into the grooves 46 and abut against a side of a ridge 44 to locate the adjacent overlapping tiles in broken bond. The ridges 44 also act as reinforcements and guard against breakages when walked on, e.g. by workmen.

The overlapping tiles 10 are spaced apart by the projections 36. When a plurality of tiles 10 are laid in upper edge to leading edge overlapping relationship, the adjacent overlapping tile lies on and is supported by the projections 36 of the tile beneath. The height of each projection 36 from the recess floor 32 is about 1 mm more than the height of the ridges 44 from the undersurface 14, thereby providing a spacing of about 1 mm between overlapping tiles. The projections 36 reduce the contact area between the overlapping rows 55 of tiles thereby minimising capillary action water uptake between the overlapping tiles. The positioning of the projections 36 and grooves 46 on the upper surface 12 and under surface 14 respectively ensures that the tiles 10 can only be laid in broken bond.

With the tiles 10 are laid in side-by-side interlocking and upper edge to leading edge overlapping relationship, the upper surface 12 of the adjacent overlapping tile projects above the shoulder 30. This means that when the tiles 10 are viewed leading edge 18 on, only the portion of the leading edge 18 lying above the shoulder 30 is visible, giving the appearance of an extremely thin visible leading edge 56. The shoulder 30 also hides the interlocks and other under surface features of the adjacent overlapping tiles.

When the tiles 10 are laid in broken bond, the interlock of the adjacent overlapping tiles is aligned with the indentation 34 at a point midway along the transverse length of the shoulder 30. Water flowing through the interlock can weep out of the indentation 34 on the shoulder 30 and onto the upper surface 12 of the tile 10 thereby preventing water from collecting in the recess 28.

Although the indentation 34 allows the interlocks of the tiles to be visible when viewed from above, the interlocks remain concealed when viewed from ground level and at an acute angle from the horizontal.

Figure 6:
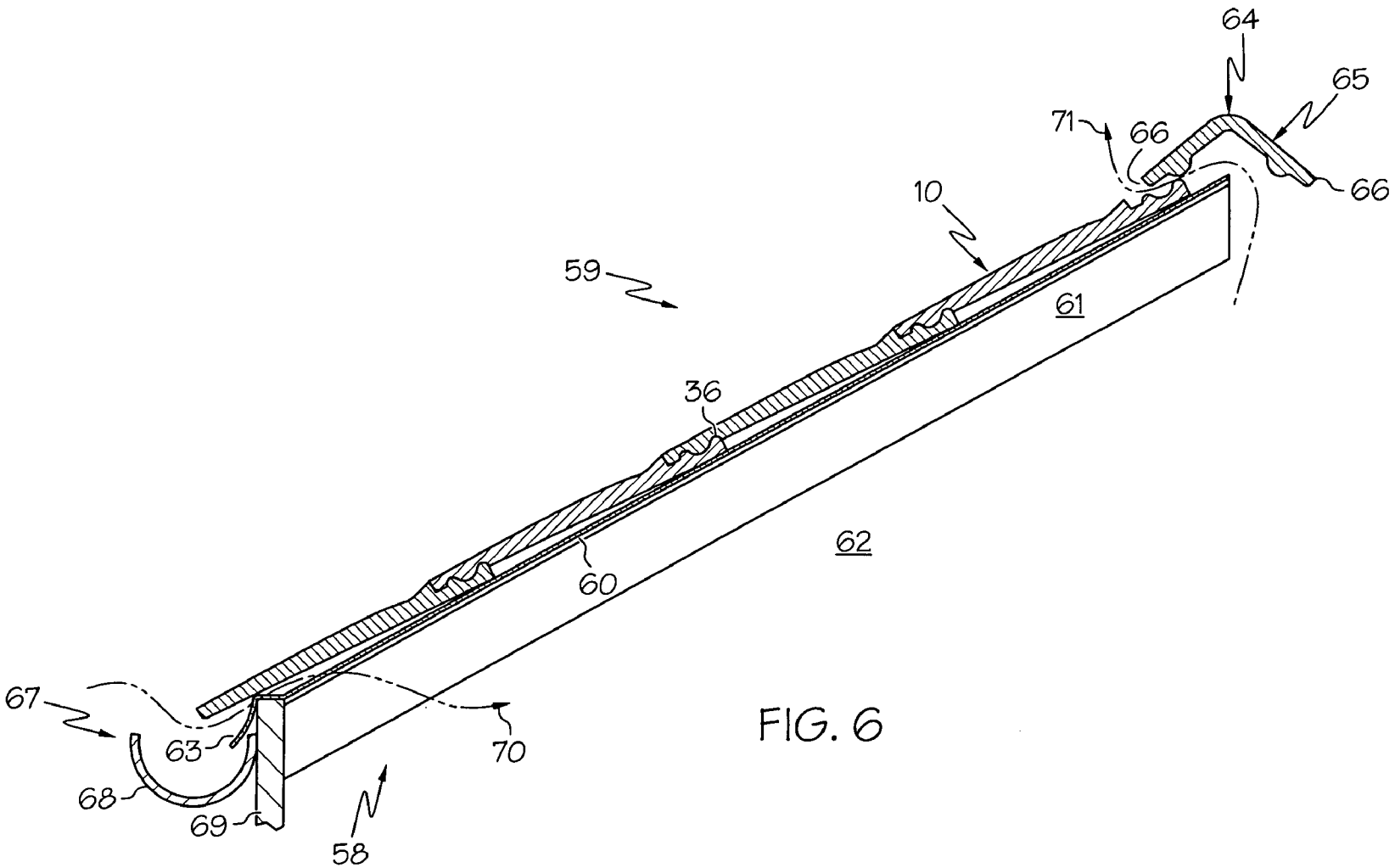
FIG. 6 is a part-cross-sectional view through a roof structure comprising a plurality of the interlocking tiles of FIG. 1 or 8 fixed to decking on roof rafters.
Figure 7:
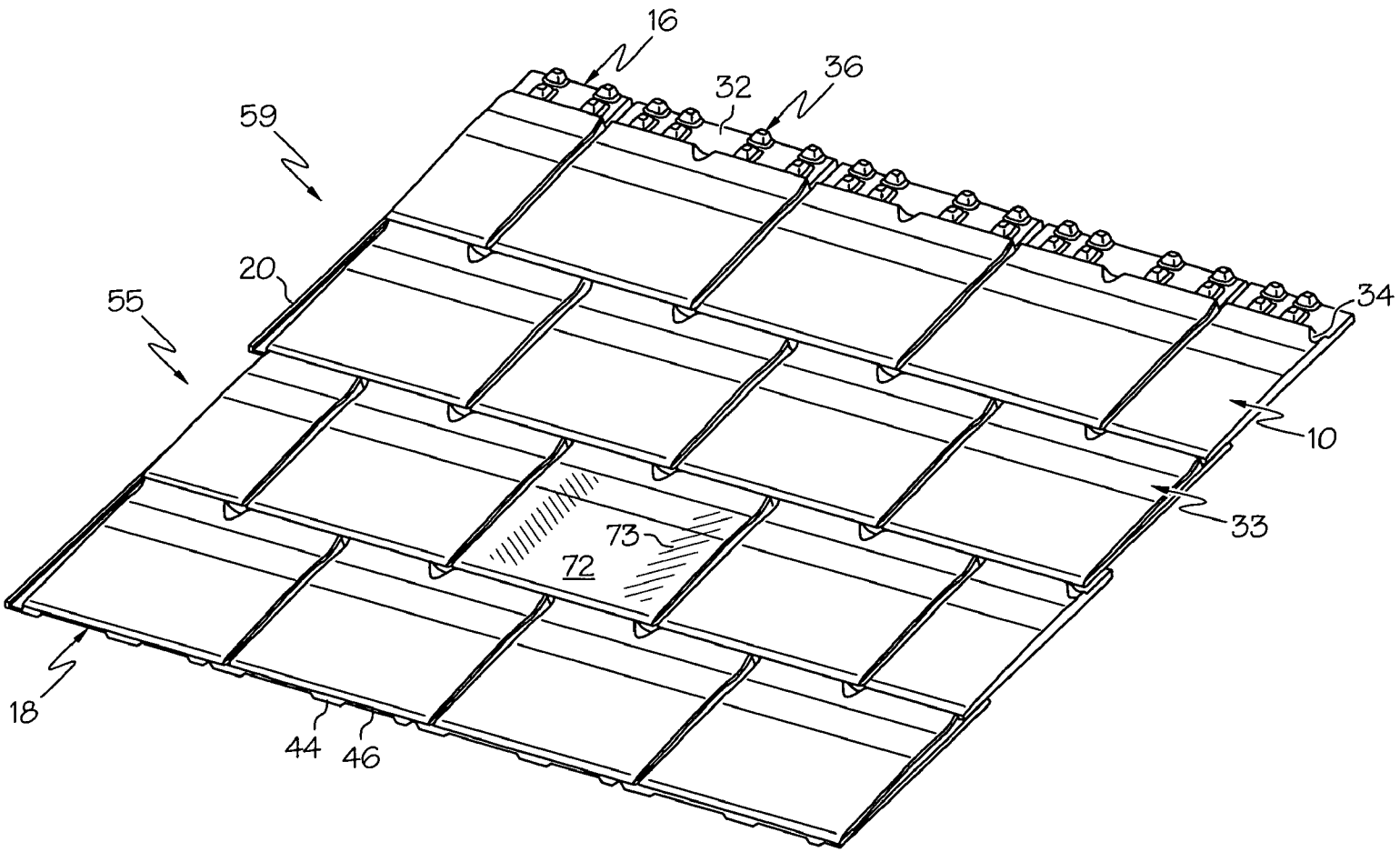
FIG. 7 is a plan view from the upper surface of part of a roof laid with the tiles of FIGS. 1 and 2.
Figure 8:
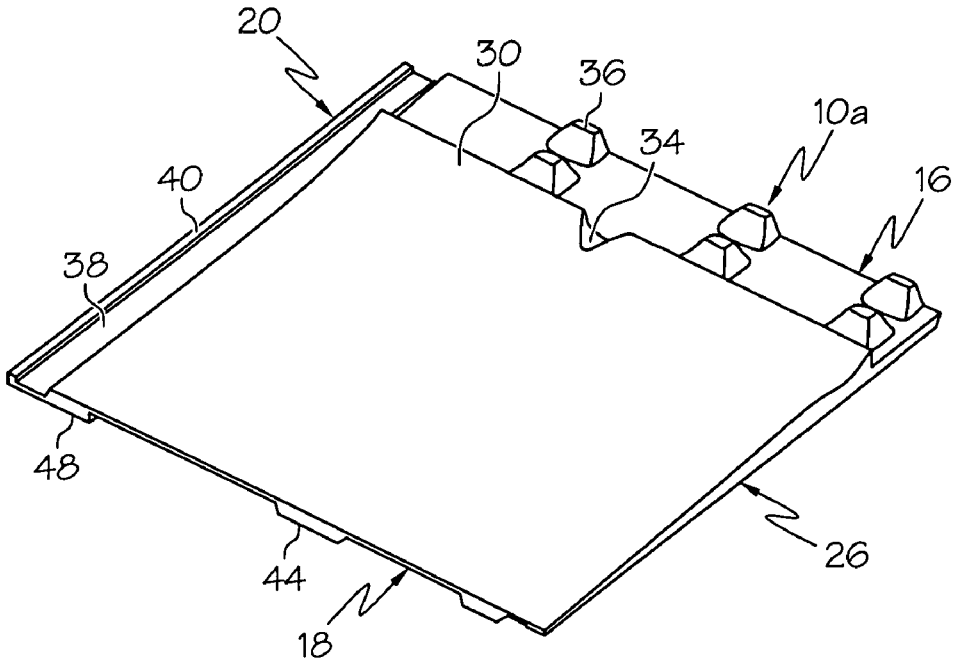
FIG. 8 is a perspective view of another embodiment of an extruded interlocking roof tile, manufactured in accordance with this invention, and viewed from the upper surface, overlock side and leading edge.
Figure 9:
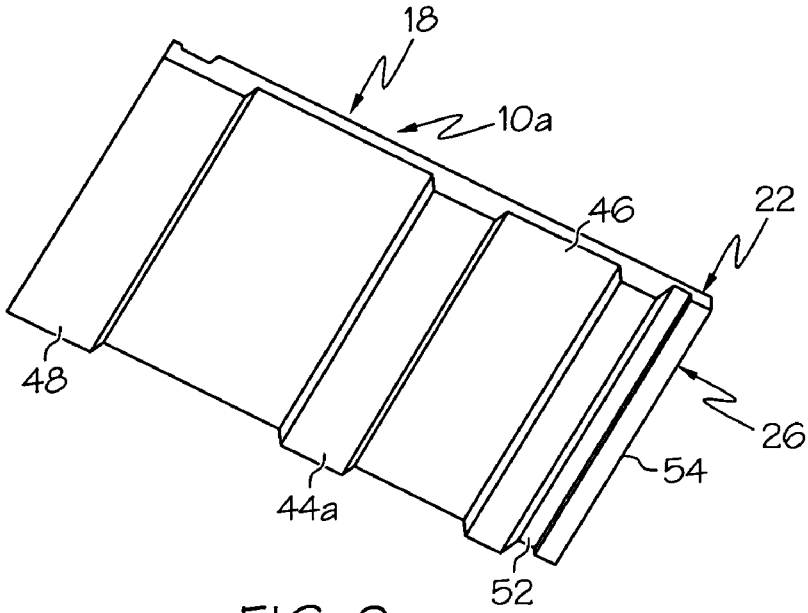
FIG. 9 is a perspective view from the under surface, overlock side and leading edge of the tile of FIG. 8.
Figure 10:
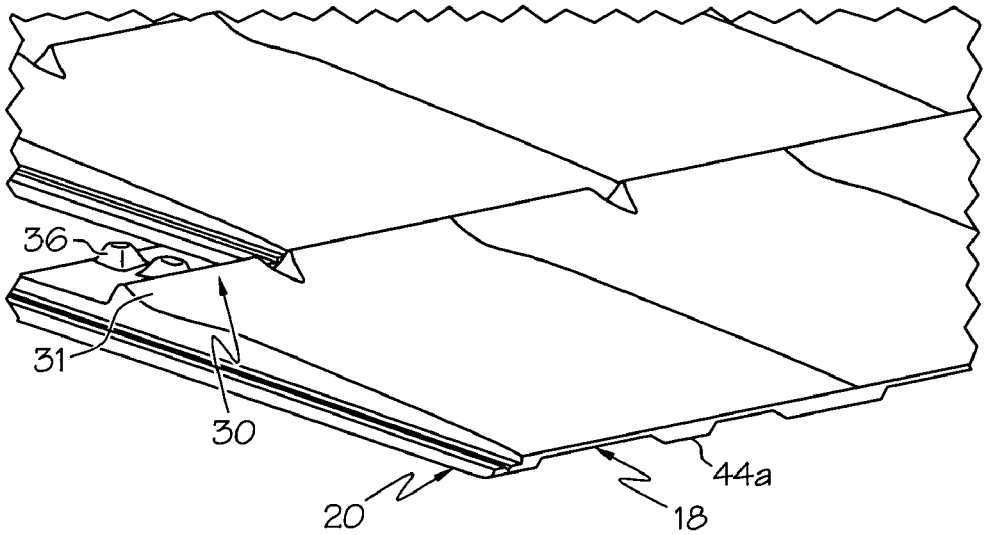
FIG. 10 is a perspective view from the upper surface, underlock side and lower edge of two rows of the tiles of FIGS. 8 and 9.
Figure 11:
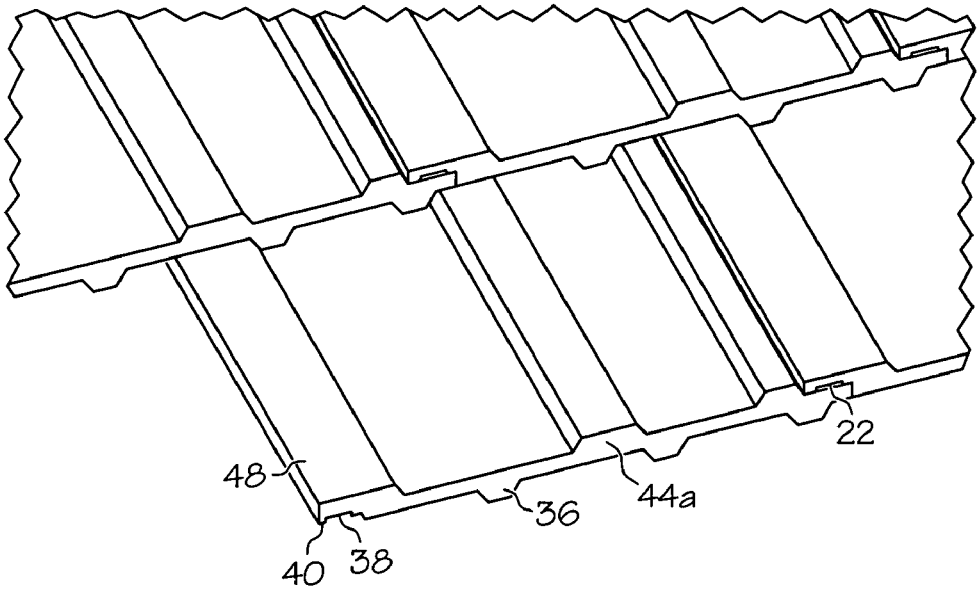
FIG. 11 is a perspective view from the undersurface, underlock side and upper edge of two rows of the tiles of FIGS. 8 and 9.

In FIG. 6, a roof structure 58 is shown in which the tiles 10 are laid in side-by-side interlocking and upper edge to leading edge overlapping relationship to form a roof 59. The tiles 10 are fixed as by nails extending through nail holes (not shown) to decking 60 secured to roof rafters such as 61 forming part of a roof structure 58 having a roof space 62.

The decking 60 is lined with roof felt 63 which is typically bitumen felt or a synthetic breather membrane. The ridge 64 of the roof structure is formed by a plurality of ridge tiles 65 with longitudinal edges 66 overlapping the recesses 28 and abutting the shoulders 30 of the adjacent row 55 of interlocking tiles 10. At the bottom of the roof structure 58, in the region of the eaves 67, guttering 68 is fixed to a fascia board 69 which is in turn secured to the lower ends of the rafters 61.

Ventilation of the laid roof structure 58 is provided at the eaves 67 conventionally and also at the ridge 64 of a laid roof 59, as indicated by the respective arrow headed chain lines 70 and 71. At the ridge 64, air flows out of the roof space 62 through gaps engendered by the spacer means 36 acting between the recess floor 32 and the longitudinal edges 66 of the overlapping ridge tiles.

Additional ventilation can be achieved by replacing one of the interlocking tiles 10 on the roof 59 with a ventilation tile 72 so that the ventilation tile 72 co-operates with the adjacent existing tiles 10 in side-by-side interlocking and upper edge to leading edge overlapping relationship. The ventilation tile 72 has ventilation slots 73 on its upper surface which open into a plenum chamber (not shown) communicating with the roof space 62 via an integral down pipe (not shown). The ventilation tile 72 is typically made of a suitable plastics material.

The embodiment shown in FIGS. 8 to 11 differs from that of FIGS. 1 to 7 in that three pairs of projections 36 are provided instead of four pairs of projections 36. Accordingly, the under surface 14 of a tile 10*a* comprises two ridges 44 instead of the three ridges 44 of tile 10. Further, instead of the two ridges 44 located midway across the tile 10, the tile 10*a* has just one ridge 44*a* having a width corresponding to the two ridges 44 and the groove 46. Advantages of the tile 10 over tile 10*a* are that for the tile 10 less material is required for the two ridges 44 thereby further reducing the weight of the tiles. Furthermore, the additional pair of projections 36 of tile 10 gives the tiles more stability when laid in broken bond. It should be appreciated that the tile 10 of FIGS. 1 to 5 can simply be substituted for the tile 10*a* of FIGS. 8 to 11 in the roof structure of FIGS. 6 and 7.

In the embodiments described, the upper and under surfaces 12, 14 of the tiles are formed respectively by the pallet and the roller and slipper.

The present invention may be embodied in other specific forms without departing from its essential attributes as defined in the appended claims and other statements of invention herein rather than the foregoing description as indicating the scope of the invention.

For example, the upper surface 12 of the tile 10, 10*a* could be textured, e.g. with corrugations or ridging or be provided with patterns. Alternatively, the shoulder 30 may merge into the upper surface 12 without a curved portion 31 e.g. by way of a linearly decreasing ramp. In addition, the spaced apart projections 36 may be of any other suitable shape other than truncated pyramidal, for example, circular in cross-section.

What is claimed is:

1. An extruded interlocking roof tile made from cementitious material and having:

upper and under surfaces;

upper and lower edges;

two opposite side edges;

wherein the upper surface has a recess extending transversely between the two opposite side edges adjacent the upper edge for receiving a lower edge of an adjacent tile in overlapping relationship, wherein the recess being delimited by a transversely extending shoulder projecting from the recess floor and acting as a stop for the lower edge of the adjacent tile, whereby when the lower edge of said adjacent tile is received in the recess, the lower edge of said adjacent tile abuts against the shoulder and a portion of the lower edge of the adjacent tile lies above the shoulder of the roof tile such that the lower edge of the adjacent tile is visible above the shoulder of the roof tile; and integral spacer means for acting between the recess floor and an undersurface of the said adjacent tile.

2. A roof tile as claimed in claim 1, wherein the said upper surface is provided with a sinuous profile when the tile is viewed from each of the said two side edges.

3. A roof tile as claimed in claim 1, wherein the recess is open on all sides except for that side which is delimited by the shoulder.

4. A roof tile as claimed in claim 1, wherein the spacer means is integral with, and projects from, the recess floor.

5. A roof tile as claimed in claim 1, wherein the spacer means comprises a plurality of spaced apart projections.

6. A roof tile as claimed in claim 5, wherein the spaced apart projections co-operate with the under surface of the said adjacent overlapping tile to ensure that the tile is laid in broken bond.

7. A roof tile as claimed in claim 5, wherein an undersurface of an adjacent tile is contoured and wherein the spaced apart projections of said roof tile co-operate with the contour.

8. A roof tile as claimed in claim 7, wherein the contour of the adjacent tile comprises at least one ridge and at least one groove extending between an upper edge of said adjacent tile and a lower edge of said adjacent tile in parallel with side edges of said adjacent tile and wherein the projections extend into the at least one groove and abut against a side of the at least one ridge to locate the adjacent overlapping tiles in broken bond.

9. A roof tile as claimed in claim 1, wherein the shoulder has a curved portion that merges into the said upper surface.

10. A roof tile as claimed in claim 1, wherein the shoulder defines an indentation, which indentation is in alignment with the interlock of the adjacent overlapping tiles when such tiles are laid in broken bond, for enabling passage of rain water from the interlocks of the adjacent overlapping tiles to the said upper surface.

* * * * *

UNITED STATES PATENT AND TRADEMARK OFFICE

CERTIFICATE OF CORRECTION

PATENT NO. : 7,003,922 B2
APPLICATION NO. : 10/301802
DATED : February 28, 2006
INVENTOR(S) : Fifield It is certified that error appears in the above-identified patent and that said Letters Patent is hereby corrected as shown below:

Col. 10, line 44-45 “projections extend” should read --projections of said roof tile extend-;

Col. 10, line 52 “the” should read --an--;

Col. 10, line 52 “tiles” should read --tile--;

Col. 10, line 53 “tiles” should read --tile--;

Col. 10, line 54 “interlocks” should read --interlock--; and

Col. 10, line 55 “tiles” should read --tile--.

Signed and Sealed this

Twenty-ninth Day of August, 2006

JON W. DUDAS
*Director of the United States Patent and Trademark Office*